US005320783A

United States Patent [19]

Marin et al.

[11] Patent Number: 5,320,783

[45] Date of Patent: Jun. 14, 1994

[54] DETERGENT GELS CONTAINING ETHOXYLATED ALKYL SULFATE SURFACTANTS IN HEXAGONAL LIQUID CRYSTAL FORM

[75] Inventors: Edgar M. Marin, Caracas, Venezuela; Alan E. Sherry, Cincinnati; Kyle D. Jones, West Chester, both of Ohio

[73] Assignee: The Procter & Gamble Company, Cincinnati, Ohio

[21] Appl. No.: 971,390

[22] Filed: Nov. 4, 1992

[51] Int. Cl.[5] ..... C11D 17/00; C11D 1/29; C11D 3/32

[52] U.S. Cl. ..... 252/544; 252/174; 252/525; 252/529; 252/532; 252/533; 252/534; 252/548; 252/551; 252/552; 252/553; 252/DIG. 14

[58] Field of Search ..... 252/544, 548, 551, 552, 252/553, 174, 525, 529, DIG. 14, 532, 533, 534

[56] References Cited

U.S. PATENT DOCUMENTS

| | | | |
|---|---|---|---|
| 2,580,713 | 1/1952 | Wood | 252/121 |
| 3,755,206 | 8/1973 | Verdier | 252/545 |
| 3,928,249 | 12/1975 | Nunziata et al. | 252/526 |
| 3,935,129 | 1/1976 | Jabalee | 252/525 |
| 4,018,720 | 4/1977 | Lengyel et al. | 252/534 |
| 4,075,129 | 2/1978 | Murata et al. | 252/527 |
| 4,079,020 | 3/1978 | Mills et al. | 252/547 |
| 4,092,272 | 5/1978 | Nishimura et al. | 252/545 |
| 4,188,311 | 2/1980 | Aalbers et al. | 252/551 |
| 4,244,840 | 1/1981 | Straw | 252/540 |
| 4,259,215 | 3/1981 | Murata et al. | 252/528 |
| 4,395,364 | 7/1983 | Murata et al. | 252/526 |
| 4,556,509 | 12/1985 | Demangeon et al. | 252/542 |
| 4,615,819 | 10/1986 | Leng et al. | 252/110 |
| 4,680,143 | 7/1987 | Edge et al. | 252/553 |
| 4,692,275 | 9/1987 | Secemski et al. | 252/534 |
| 4,732,707 | 3/1988 | Naik et al. | 252/548 |
| 4,784,800 | 11/1988 | Leng et al. | 252/548 |
| 4,880,569 | 11/1989 | Leng et al. | 252/550 |
| 4,923,635 | 5/1990 | Simion et al. | 252/545 |
| 4,975,218 | 12/1990 | Rosser | 252/117 |
| 5,035,826 | 7/1991 | Durbut et al. | 252/121 |
| 5,096,622 | 3/1992 | Simion et al. | 252/548 |
| 5,230,823 | 7/1993 | Wise et al. | 252/174.21 |

FOREIGN PATENT DOCUMENTS

| | | |
|---|---|---|
| 1070590 | 1/1929 | Canada . |
| 0387063A2 | 9/1990 | European Pat. Off. . |
| 0485212A1 | 5/1992 | European Pat. Off. . |
| 540233 | 1/1985 | Spain . |
| 1382295 | 1/1975 | United Kingdom . |
| 2179053A | 2/1987 | United Kingdom . |
| 2179054 | 2/1987 | United Kingdom . |
| 2179055 | 2/1987 | United Kingdom . |

*Primary Examiner*—Paul Lieberman
*Assistant Examiner*—A. E. Hertzog
*Attorney, Agent, or Firm*—Jacobus C. Rasser; Donald E. Hasse; Gary M. Sutter

[57] ABSTRACT

A detergent composition comprising a gel wholly or predominantly in hexagonal liquid crystal form comprising: (a) 15% to 70% surfactant system, wherein at least 40% by weight of the surfactant system is an ethoxylated alkyl sulfate surfactant, wherein the alkyl group of the ethoxylated alkyl sulfate surfactant has an average of from 8 to 20 carbon atoms, and wherein the ethoxylated alkyl sulfate surfactant has an average degree of ethoxylation of from 0.5 to 15; (b) 1% to 45% additive which is a water-soluble non-micelle-forming or weakly micelle-forming material capable of forcing the surfactant system into hexagonal phase, the additive being anionic or nonionic and having at most 6 aliphatic carbon atoms, and the additive being selected from the lower amides or mixtures thereof; and (c) 20% to 70% water. The detergent gel has excellent viscosity, overall consistency, foaming, stability and appearance, and provides good cleaning ability. Dishcare gels are preferred.

23 Claims, No Drawings

DETERGENT GELS CONTAINING ETHOXYLATED ALKYL SULFATE SURFACTANTS IN HEXAGONAL LIQUID CRYSTAL FORM

FIELD OF THE INVENTION

This invention relates to detergent compositions, in particular detergents in the form of gels having excellent physical properties. A preferred embodiment of the invention is dishcare gels.

Detergents in gel form present many advantages. For example, gel hard surface cleaners adhere well to the surfaces to be cleaned, are easy to use, and provide concentrated cleaning ability. Similarly, laundry detergents in gel form are particularly good at stain removal because they provide a concentrated amount of surfactants. As another example, dishcare gels are preferred for use in washing dishes in some parts of the world. The gel product form best lends itself to the "direct application" habit in which persons apply a sponge or other cleaning applicator directly onto the dishcare detergent and then onto the dishes; the dishes are then typically washed and rinsed under running water. Additionally, gels can be stored in inexpensive tubs instead of the more complex plastic bottles required for liquid cleaners.

It is very important for detergent gels to have the desired physical properties, such as overall consistency (particularly viscosity), stability, foaming ability, and appearance, as well as providing good cleaning properties.

Therefore, it is an object of the present invention to provide detergent compositions in the form of gels.

It is another object of the present invention to provide detergent gels having excellent physical properties and cleaning ability.

It is a particular object of the present invention to provide dishcare gels.

These and other objects of the invention will be described in further detail herein.

SUMMARY OF THE INVENTION

The present invention relates to a detergent composition comprising a gel wholly or predominantly in hexagonal liquid crystal form, said gel comprising:

(a) from about 15% to about 70% by weight of a surfactant system, wherein at least about 40% by weight of the surfactant system is an ethoxylated alkyl sulfate surfactant, wherein the alkyl group of the ethoxylated alkyl sulfate surfactant has an average of from about 8 to about 20 carbon atoms, and wherein the ethoxylated alkyl sulfate surfactant has an average degree of ethoxylation of from 0.5 to about 15;

(b) from 1% to about 45% by weight of an additive which is a water-soluble non-micelle-forming or weakly micelle-forming material capable of forcing the surfactant system into hexagonal phase, the additive being anionic or nonionic and having at most 6 aliphatic carbon atoms, and the additive being selected from the group consisting of the lower amides and mixtures thereof; and (c) from about 20% to about 70% by weight of water.

The detergent gel has excellent viscosity, overall consistency, foaming, stability and appearance, and provides good cleaning ability. Preferred detergent gels according to the invention are dishcare gels, which are very good in their ability to remove food soils and cut grease.

DETAILED DESCRIPTION OF THE INVENTION

As background, U.S. Pat. No. 4,615,819 to Leng et al., issued Oct. 7, 1986 discloses detergent gel compositions in hexagonal liquid crystal form that are made from certain "secondary" anionic or cationic surfactants (described hereinafter at pages 6–7) in combination with certain additives such as urea; and U.K. Patent Application 2,179,054 A of Leng et al., published Feb. 25, 1987, discloses detergent gels in hexagonal liquid crystal form containing a non-ethoxylated non-soap anionic surfactant such as a primary alkyl sulfate, together with either an auxiliary surfactant or a specified additive. In contrast to the Leng et al. patent and application, it has now been discovered that ethoxylated alkyl sulfate surfactants, which are ethoxylated primary surfactants, can be used to provide excellent detergent gels in hexagonal liquid crystal form when they are combined with the lower amide additives described in the Leng et al. patent. In view of the fact that it is difficult to obtain detergent gels having both the desired physical properties and the desired cleaning properties, and the making of detergent gels and their resulting crystal form is so unpredictable, it is surprising that excellent gels in hexagonal liquid crystal form can be made with ethoxylated alkyl sulfate surfactants in combination with these additives.

A detergent gel composition according to the present invention comprises from about 15% to about 70% by weight of a "surfactant system", by which is meant the total amount of all the surfactants in the detergent composition including the ethoxylated alkyl sulfate surfactant. At least about 15% surfactant system is needed to make a suitably thickened gel. Above about 70% total surfactant concentration, the mixture is not likely to exist in the hexagonal phase. A detergent composition according to the present invention preferably comprises from about 20% to about 55% surfactant system, and most preferably from about 25% to about 40%. An advantage of the present invention is that relatively low total surfactant levels can be used while still obtaining excellent cleaning performance and gel structure.

A key of the present invention is that the surfactant system of the detergent gels must in large part comprise the ethoxylated alkyl sulfate surfactant. An ethoxylated alkyl sulfate surfactant, $AE_xS$, is one having, on average, "x" degree of ethoxylation (where "x" is between 0.5 and about 15 for the present detergent compositions). At least about 40% by weight of the surfactant system is the ethoxylated alkyl sulfate surfactant. Preferably, ethoxylated alkyl sulfate surfactant comprises at least about 55% of the surfactant system, and most preferably at least about 65%. It is also preferred that a detergent composition of this invention contains from about 15% to about 65% ethoxylated alkyl sulfate surfactant by weight of the detergent composition as a whole, more preferably from about 17% to about 30%, and most preferably from about 18% to about 25%.

The alkyl group of the ethoxylated alkyl sulfate surfactant can have an average of from about 8 to about 20 carbon atoms, preferably from about 8 to about 15 carbon atoms, and most preferably from about 12 to about 15 carbon atoms. The alkyl groups are preferably linear, but they can also be branched. The ethoxylated alkyl sulfate surfactants have an average degree of ethoxylation of from 0.5 to about 15, and preferably from about 1 to about 6.5.

The cation group combined with the ethoxylated alkyl sulfate surfactant (an anionic surfactant) can be sodium, potassium, lithium, calcium, magnesium, ethylene diamine, ammonium, or lower alkanol ammonium ions, and other cations which are known in the detergent field to be useful in surfactants. Most preferred are cations selected from the group consisting of sodium, magnesium, calcium, and mixtures thereof. The preferred sodium or magnesium ethoxylated alkyl sulfate surfactant can be either introduced as a raw material, or it can be generated in situ through counterion exchange with $Na^+$ or $Mg^{++}$ salts.

Preferred ethoxylated alkyl sulfate surfactants according to the present invention include those where the alkyl group is derived from coconut or palm base, such as mid-cut coconut ($C_{12-14}$) or broad-cut coconut ($C_{12-18}$). Surfactants of this type are available commercially from Akzo Chemicals, 516 Duren, West Germany, under the tradenames ELFAN NS 243 S conc. and NS 242 S conc. ($Na^+$ cation, alkyl group having an average chain length of $C_{12-14}$, average degree of ethoxylation of 3 and 2 respectively), and ELFAN NS 243 S $Mg^{++}$ concentrate (same as above, but with $Mg^{++}$ cation). Preferred ethoxylated alkyl sulfates of this type are also available commercially from Hoechst Corp., Venezuela, and Taiwan NJC Corp., No. 45, Chung-Cheng Rd., Ming-Hsiung Industrial Park, Ming Hsuing, Chia-Yi Hsien, Taiwan, R.O.C. (Na $AE_2S$ and Na $AE_3S$, where the alkyl group is $C_{12-14}$). Synthetic surfactants (derived from synthetic alcohols) such as those containing $C_{12-13}$ or $C_{12-15}$ alkyl groups are also preferred. Such synthetic surfactants are commercially available from South Pearl Corp., Puerto Rico, U.S.A. and other companies. Specific examples of preferred surfactants are Na $C_{12-14}AE_2S$, Na $C_{12-15}AE_3S$, Na $C_{12-13}AE_1S$, and their counterparts containing magnesium cations and/or having other degrees of ethoxylation. Other suitable surfactants include, but are not limited to, ethoxylated alkyl sulfate surfactants where the alkyl group is lauryl ($C_{12}$) or myristyl ($C_{14}$).

When a sodium ethoxylated alkyl sulfate is used, it is desirable to also add the divalent $Mg^{++}$ ions, $Ca^{++}$ ions, or mixtures thereof to the detergent compositions for improved technical performance. For example, 0.6% to 0.8% magnesium ion could be added to improve cleaning performance as indicated by a lower interfacial tension and/or to improve ease of processing. Magnesium ions are typically added in the form of magnesium citrate, magnesium sulfate, magnesium formate, magnesium chloride or magnesium acetate, while calcium ions are typically added in the form of calcium formate, calcium acetate or calcium chloride. Preferred formulations contain from about 0.3% to about 1.5% $Mg^{++}$ ions by weight in the final product. The magnesium ions are preferably introduced in the form of magnesium citrate, which can be used either as a raw material or formed in situ by the reaction of magnesium hydroxide with citric acid. Calcium ions may be preferred over magnesium ions for improved grease cleaning ability, particularly when low levels of divalent ion are used. $Mg^{++}$ or $Ca^{++}$ ions can also be introduced into the products as the cation portion of the "secondary surfactant" [for example, as $Mg(LAS)_2$].

Along with the ethoxylated alkyl sulfate surfactant, the detergent composition of the present invention also contains from 1% to about 45% by weight of a certain "additive", preferably from about 5% to about 40% additive, and most preferably from about 10% to about 30%. The additive is a water-soluble non-micelle-forming or weakly micelle-forming material capable of forcing the surfactant system into hexagonal phase, the additive being anionic or nonionic and having at most 6 aliphatic carbon atoms, and the additive being selected from the group consisting of the lower amides and mixtures thereof. Urea is the most preferred type of additive. Short chain urea homologs and analogs, for example, methyl and ethyl ureas, formamide, and acetamide, are other useful additives. A preferred mixture of lower amides is urea and acetamide. Increasing the level of urea for a given formulation results in an increase in gel melting point and viscosity. Optimum levels of urea are between about 10% and about 25%, preferably between about 15% and about 25%.

A detergent composition according to the invention also contains from about 20% to about 70% by weight of water, preferably from about 25% to about 55%, and most preferably from about 30% to about 50%. The amounts of water, additive, surfactant and any other ingredients in the detergent composition are adjusted to make a gel having the desired thickness and overall consistency. Thicker gels are made by increasing the amounts of surfactant, additive and other ingredients in the compositions in comparison with the amount of water in the compositions.

An optional ingredient in the detergent composition of the invention is a "secondary surfactant" as they are described in the Leng et al. patent at column 2, line 5 to column 5, line 53 (incorporated by reference herein), except that only anionic "secondary surfactants" are used in the present invention (whereas the Leng et al. patent includes both anionic and cationic secondary surfactants). A detergent composition of this invention can optionally contain from 1% to about 25% of such "secondary surfactant" by weight of the surfactant system, preferably from about 10% to about 25% by weight of the surfactant system, and most preferably from about 15% to about 25% by weight. Not more than about 25% of the surfactant system (total amount of surfactants) used in a detergent composition of the invention can comprise the "secondary surfactant". If a "secondary surfactant" is used, it is preferred that the weight ratio of ethoxylated alkyl sulfate surfactant to "secondary surfactant" in the surfactant system is at least about 2:1, preferably between about 2:1 and about 4:1. The description of the "secondary" surfactant disclosed in the Leng et al. patent will not be discussed herein in detail. Briefly, however, in the "secondary" surfactant, the polar head group is either attached to the hydrophobic hydrocarbon chain in a non-terminal position, or itself occupies a non-terminal position within the chain, that is to say, 2 or more shorter chains are directly attached to the head group itself. Examples of the first type of "secondary" surfactant include alkyl benzene sulfonates, secondary alkane sulfonates and secondary alkyl sulfates. A preferred secondary surfactant for use in dishcare gels of the present invention is magnesium linear alkylbenzene sulfonate [$Mg(LAS)_2$] having an average alkyl chain length of 10.8 to 12.8 carbons. Examples of the second type of "secondary" surfactant are dialkylsulfosuccinates and quaternary ammonium salts such as di(coconut alkyl) dimethyl ammonium salts.

Nonionic surfactants can optionally be added to a detergent composition of the invention to provide improved mildness and improved cleaning performance. If nonionic surfactants are added, they can be used in amounts of from 1% to about 45% by weight of the surfactant system, preferably from 1% to about 35% by weight of the surfactant system, and most preferably from about 5% to about 17% by weight. Preferably, the weight ratio of ethoxylated alkyl sulfate surfactant to nonionic surfactant used in the invention is at least about 1.5:1, more preferably at least about 2:1, and most preferably between about 5:1 and about 7:1. Nonionic surfactants can include the fatty acyl ethanolamides, ethoxylated fatty alcohols, alkyl phenols, polypropylene oxides, polyethylene oxides, copolymers of polypropylene oxide and polyethylene oxide, sorbitan esters, and the like. Preferred nonionic surfactants are water-soluble amine oxides containing one alkyl moiety of from about 10 to about 18 carbon atoms and 2 moieties selected from the group consisting of alkyl groups and hydroxyalkyl groups containing from about I to about 3 carbon atoms. Preferred amine oxide surfactants in particular include $C_{10-18}$ alkyl dimethyl amine oxides and $C_{8-12}$ alkoxy ethyl dihydroxy ethyl amine oxides. For example, $C_{12-14}$, $C_{14-16}$, $C_{16-18}$ and $C_{12-18}$ alkyl dimethyl amine oxides are available commercially from Stepan Chemical Company under the tradename Ammonyx. The Procter & Gamble Company also manufactures suitable amine oxides such as $C_{10-16}$ alkyl dimethyl amine oxides. In general, preferred ratios of ethoxylated alkyl sulfate surfactant to amine oxide are from about 2:1 to about 15:1, more preferably from about 3:1 to about 11:1, and most preferably from about 3:1 to about 6:1. (Ratios between about 3:1 and about 6:1 provide optimum cleaning performance as indicated by interfacial tension measurements.)

Other surfactants known to those skilled in the art can also be used in the present invention, but such other surfactants should be limited to no more than about 45% by weight of the surfactant system, preferably no more than about 30%, and most preferably no more than about 10%. The other surfactants can be other anionic surfactants that are not ethoxylated alkyl sulfate surfactants or "secondary" surfactants; or cationic, zwitterionic, ampholitic or amphoteric surfactants (these surfactants being known to persons skilled in the art). Betaines are preferred amphoteric surfactants, for example alkyl betaines, or amido betaines such as coco amido propyl betaine.

When urea is used as the "additive" in the present detergent compositions, it is preferred to add a small amount of boric acid to control ammonia evolution and resultant malodor that can sometimes result from base catalyzed degradation of urea (preferably using a ratio of urea to boric acid between 10:1 and 20:1). However, boric acid generally decreases the viscosity of the ethoxylated alkyl sulfate gels, so that it is preferable that the boric acid not constitute more than about 5% by weight of the total product formulation (i.e., 0.1% to 5.0% is preferred). Optimum ratios of ethoxylated alkyl sulfate surfactant to boric acid are from about 50:1 to about 5:1, more preferably from about 20:1 to about 8:1.

The detergent gel compositions of the invention can contain up to about 20% by weight detergent builder, particularly when the detergent compositions are used as laundry detergents. Laundry detergent gels according to the invention preferably contain between 1% and about 15% by weight detergent builder, and most preferably between 1% and about 10% by weight. The detergent builders can be, for example, water-soluble alkali metal salts of phosphates, pyrophosphates, orthophosphates, tripolyphosphates and higher polyphosphates, phosphonates, silicates, citrates, tartrates, and mixtures thereof. In general, however, detergency builders have limited value in dishwashing detergent compositions and use at levels above about 10% in such compositions can restrict formulation flexibility.

A major challenge of the present invention was to obtain the desired viscosity for the detergent gels. This involved adjusting the amounts of surfactants, additives, and electrolytes, and preferably avoiding overheating during processing. High levels of electrolytes adversely affect the gel structure, and the resulting composition can turn into a liquid instead of a gel. Accordingly, the level of electrolytes should be kept below about 10% by weight of the present detergent compositions, preferably below about 8% by weight, and most preferably below about 6% by weight. For example, the level of sodium sulfate or magnesium sulfate impurity present in the ethoxylated alkyl sulfate surfactant used in the present invention should be kept low. Additionally, when the cation of the ethoxylated alkyl sulfate is sodium, the level of magnesium salts added for performance should be kept low. If electrolytes are added to the present compositions as part of the builders or other optional additives, the level should be kept below the above-mentioned limit. For the purposes of this invention, "electrolytes" are defined as common inorganic or organic salts which are either incorporated in the raw material due to a manufacturing process (e.g., $Na_2SO_4$ in Na $AE_3S$) or are intentionally added for performance benefits in the formulations (e.g., $MgSO_4$ or $MgCl_2$).

"Electrolytes" are more fully described in U.S. Pat. No. 4,615,819 to Leng et al. (assigned to Lever Brothers Co.), issued Oct. 7, 1986, at column 6, line 57 to column 7, line 25 (incorporated by reference herein).

The detergent compositions of this invention can contain thickening or suspending agents to obtain even higher viscosities. If added thickener is used in the compositions, it is preferably used in the amount between 1% and about 5% by weight of the composition. Preferred thickeners include cellulosic polymers and oligomers substituted to varying degrees with different groups, such as carboxymethyl cellulose, hydroxyethyl cellulose, methoxypropyl cellulose, ethoxypropyl cellulose and hydroxypropyl cellulose. Other suitable thickeners include gums such as guar gum and gum tragacanth, polystyrenes, polyacrylates, polyethylenes, polypropylenes, copolymers of polyethylene and polypropylene, and copolymers of styrene with monomers such as maleic anhydride, nitrilonitrile, methacrylic acid and lower alkyl esters of methacrylic acid, and copolymers of styrene with methyl or ethyl acrylate, methyl or ethyl maleate, vinyl acetate, acrylic, maleic, or fumaric acids and mixtures thereof. The gel strength of the detergent compositions can also be increased by adding fillers such as colloidal clays (e.g., bentonites), silica and silicates that reduce the amount of water in the system.

Materials can be added to the present detergent compositions that will further lower the interfacial tension of the detergents and thereby provide even better cleaning. For example, materials such as "soaps" can be added, including the sodium, potassium, ammonium and alkanolammonium salts of higher fatty acids. Particularly useful are the sodium and potassium salts of the mixtures of fatty acids derived from coconut oil and tallow.

The amount of short chain alcohols and glycols ($C_6$ alcohols or lower, e.g., ethyl alcohol, propyl alcohol, ethylene glycol, glycerin) used in the detergent gel compositions should be limited because such alcohols and glycols tend to interfere with formation of a gel structure. It is preferred to limit the amount of short chain alcohols and glycols to not more than 15% by weight, more preferably not more than 10% by weight, and most preferably not more than 6% by weight. Small amounts of alcohol or glycol within these limits can be used as a processing aid in the formation of gels, and to adjust the viscosity and phase properties of the final product.

The detergent compositions of the invention can contain, if desired, any of the usual adjuvants, diluents and additives known to those skilled in the art for use in detergents, for example, bleaching agents, perfumes, enzymes, dyes, antitarnishing agents, antimicrobial agents, abrasives, suds enhancers, coloring agents, and the like, without detracting from the advantageous properties of the compositions. Amino acids such as glycine can also be added for improved cleaning of protein-based soils. The preferred gel detergent composition of the present invention is a clear or translucent gel, but the additives can opacify the gel.

It has been found that the detergent compositions containing ethoxylated alkyl sulfate surfactant, additive and water generally have a basic (alkaline) pH. To provide optimum cleaning properties and product viscosity, the pH of the present detergent compositions is preferably maintained at a pH between about 7.0 and about 9.0, more preferably between about 7.0 and about 8.0. Therefore, it is sometimes preferable to add acids and/or pH buffering agents to the compositions. Suitable acids include toluene sulfonic acid, xylene sulfonic acid, cumene sulfonic acid, linear alkylbenzene sulfonic acids, and mixtures thereof. Suitable buffering agents include fatty acids, formic acid, citric acid, malic acid, boric acid (discussed above), and mixtures thereof.

The detergent compositions of the present invention are in the form of gels which have a viscosity between about 1,000,000 centipoise and about 8,000,000 centipoise. Gels having viscosities in the lower part of this range are suitable for detergent compositions which require soft gels, such as shampoos. Firmer gels are preferred for use as dishcare detergents, particularly dishcare gels intended for use in the "direct application" habit described hereinabove. It is preferred that the viscosity of dishcare gels according to the invention is between about 1,000,000 centipoise and about 6,000,000 centipoise, more preferably between about 1,500,000 centipoise and about 5,000,000 centipoise, and most preferably between about 2,000,000 centipoise and about 4,500,000 centipoise. Very firm gels can be used for toilet bar soaps according to the invention.

Viscosity measurements of the gels of this invention are taken by means of an Exact Viscometer HAAKE RV20 ROTOVISCO using Cone PK1; 1° with M=30.2. The viscosity of the gels is measured on a 1 gram sample of the gel sandwiched between the Cone and the instruments plate, using a shear rate gradient of 0 to 3 seconds$^{-1}$, at a temperature of 23° C. (73.4° F). The recorded viscosity corresponds to the highest viscosity reading obtained on the instrument when a sweep time of 2 minutes is used.

A detergent gel according to this invention is wholly or predominantly in hexagonal liquid crystal form. By "predominantly" is meant greater than about 50%. The liquid crystal form of the detergent gel can be determined by polarizing light microscope studies, use of X-ray diffraction or other various microscopic techniques known to persons skilled in the art. The hexagonal liquid crystal form is intermediate in rigidity between the lamellar and cubic liquid crystal forms. The hexagonal liquid crystal form is further described at column 3, lines 12–31, of U.S. Pat. No. 4,615,819 to Leng et al., issued Oct. 7, 1986 (incorporated by reference herein).

The detergent compositions of this invention can be dishwashing detergents for use with the "direct application" habit discussed above, or for use with batch dishwashing typical of liquid detergents; general purpose household cleaners for use in cleaning hard surfaces such as metal, glass, ceramic, tile and linoleum; concentrated laundry detergents and/or stain removers including gel laundry detergents and laundry bars made from hard gels; toilet bar soaps (particularly with added magnesium cation); hand cleaners; shampoos; or other detergent compositions known in the detergent field. Advantageously, while the detergent compositions provide excellent cleaning ability, they are also mild enough for use in toilet soaps, shampoos and similar products. Laundry detergents according to the invention will contain a large amount of surfactant, builder, and typically components such as brighteners, bleach, enzymes, chelating agents, and suds suppressors. General purpose household hard surface cleaners according to the invention will contain surfactants and builder in generally similar amounts, sometimes an abrasive, and al so preferably a non-aqueous polar solvent such as methanol, ethanol, propanol, ethylene glycol, propylene glycol and glycerin, with the amount of such solvent limited to not more than about 15% by weight to avoid interference with the gel structure. A toilet bar soap according to the invention will typically contain a large proportion of soap, and preferably a skin mildness aid, in addition to the other ingredients.

Most preferred detergents according to this invention are dishcare gels suitable for use with the direct application habit, in removing food soils from housewares including dishes, pots and pans, glasses, utensils, etc. The dishcare gels of the invention have very good cleaning ability, particularly cleaning grease/oil and related soils, as indicated by interfacial tension and grease emulsification measurements, and the gels have desired foaming properties. Moreover, the gels have a smooth, homogeneous consistency, excellent viscosity, and an attractive transparent or translucent appearance.

The detergent compositions of the invention can be prepared in any suitable manner, for instance by simply mixing together the components. It is preferable to mix the components at elevated temperature, and with continual stirring to ensure complete dissolution of the components. However, to make a good gel, it is preferable to avoid overheating the composition during processing; preferably the temperature of the composition during processing is kept below about 190° F. (88° C.). A preferred order of mixing the components is to first mix the water, any nonionic surfactant, and other ingredients, and then mix in the urea and any secondary surfactant, and lastly mix in the ethoxylated alkyl sulfate surfactant. Another preferred process is to first mix together the ethoxylated alkyl sulfate surfactant and the secondary surfactant, before mixing in the water and the remaining ingredients. The order of mixing is not critical. Details of preferred compositions and processes are disclosed in the following examples.

EXAMPLE 1

A dishcare gel according to the present invention is made as follows:

| Final Product Formula: | Active Percent |
|---|---|
| Sodium triethoxylated alkyl sulfate* | 20.6% |
| $Mg(C_{11.8}LAS)_2$** | 8.0% |
| Amine oxide*** | 3.4% |
| Boric acid | 1.0% |
| $Mg^{++}$ from magnesium citrate | 0.3% |
| Urea | 20.0% |
| Dye | 0.002% |
| Perfume | 0.5% |
| Water | 46.7% |

*Na $C_{12-15}$ $AE_3S$ (69.3% active, manufactured by South Pearl Corp., Puerto Rico, U.S.A.)
**Magnesium linear alkylbenzene sulfonate, alkyl groups having average chain length of 11.8 carbons (50% active, manufactured by Hoechst Corp., Venezuela)
***$C_{10-16}$ Dimethyl amine oxide (32% active, manufactured by The Procter & Gamble Co., Cincinnati, OH, U.S.A.)

Process

To 19.40 grams of water are added, in sequence, 0.20 grams of dye solution (1% active), 10.7 grams of amine oxide stock, 0.72 grams of magnesium hydroxide, 1.59 grams of citric acid stock (99.5% active) and 1.01 grams of boric acid stock (99% active), and all mixed at a temperature of about 75°-80° F. (about 24°-27° C.). The mixture is then heated to 140° F. (60° C.) and continually stirred to ensure complete dissolution of all chemical components. At 140° F. (60° C.), 20.20 grams of urea (99% active) and 16.0 grams of $Mg(C_{11.8}LAS)_2$ stock are added and dissolved; then at 160° F. (71° C.), 0.50 grams of perfume and 29.70 grams of Na $C_{12-15}$ $AE_3S$ stock are added and dissolved. The resulting mixture is a fluid mixture at 160° F. (71° C.) and cools to yield a slightly translucent gel. Gel viscosity is 1,900,000 centipoise. The dishcare gel composition is predominantly in hexagonal liquid crystal form, as determined by X-ray diffraction. The level of electrolytes in the composition is about 4%. The interfacial tension ("IFT") of the product is 0.8 dynes/cm, indicating good cleaning ability. (IFT is measured at 6% product concentration, at 73° F. [23° C.], not more than 10 grains per gallon water hardness, using a "soil" composed of 99.8% canola oil and 0.2% oleic acid, and measured by a Model 500 Spinning Drop Interfacial Tensiometer manufactured by the University of Texas, Austin, Tex., U.S.A.) The pH of the product at 6% concentration in water is 8.0. The product provides good sudsing (foaming) and has excellent stability.

EXAMPLE 2

A dishcare gel according to the present invention is made as follows:

| Final Product Formula: | Active Percent |
|---|---|
| Sodium diethoxylated alkyl sulfate* | 22.0% |
| $Mg(C_{11.8}LAS)_2$** | 8.0% |

-continued

| Final Product Formula: | Active Percent |
|---|---|
| Amine oxide*** | 2.61% |
| $Mg^{++}$ from magnesium citrate**** | 0.38% |
| Urea | 19.8% |
| Boric acid | 1.98% |
| Water | 45.2% |

*Na $C_{12-14}$ $AE_2S$ (71.9% active, manufactured by Hoechst Corp., Venezuela)
**Same as in Example 1
***$C_{10-16}$ Dimethyl amine oxide (31.5% active, manufactured by The Procter & Gamble Co., Cincinnati, OH, U.S.A.)
****The magnesium citrate is formed by the reaction of magnesium hydroxide with citric acid. To 0.91 grams of magnesium hydroxide dissolved in 6.30 grams of water, 2.09 grams of 99% active citric acid are added at a temperature of about 75°-80° F. (about 24°-27° C.). The mixture is stirred until all of the solution is completely clear. The reaction forms 2.12 grams of magnesium citrate.

Process 16.00 grams of $Mg(C_{11.8}LAS)_2$ stock and 30.61 grams of Na $C_{12-14}$ $AE_2S$ stock are mixed together and stirred at a temperature of about 75°-80° F. (about 24°-27° C.). The resulting mixture is then heated. When the temperature reaches 120° F. (49° C.), 8.28 grams of amine oxide stock and 2.12 grams of pre-formed magnesium citrate in 6.30 grams of water, are added to the reaction mixture. At 175° F. (79° C.) 20.00 grams of 99% active urea stock and 2.0 grams of 99% active boric acid dissolved in 14.0 grams of water are added. Stirring is maintained at 180° F. (82° C.) for an additional 15 minutes or until the product is completely homogeneous. The mixture gels upon cooling. Gel viscosity is 4.1 million centipoise. The dishcare gel composition is predominantly in hexagonal liquid crystal form. The level of electrolytes in the composition is about 4%. The product has desirable cleaning ability, good foaming, and excellent stability.

EXAMPLE 3

A dishcare gel according to the present invention is made as follows:

| Final Product Formula: | Active Percent |
|---|---|
| Sodium triethoxylated alkyl sulfate* | 20.6% |
| $Mg(C_{11.8}LAS)_2$* | 8.0% |
| Amine oxide* | 3.4% |
| Boric acid | 1.0 |
| $Ca^{++}$ from $CaCl_2$ | 0.3% |
| Urea | 20.0% |
| Dye | 0.002 |
| Perfume | 0.5% |
| Water | 46.7% |

*Same as in Example 1

Process

To 20.84 grams of water are added, in sequence, 0.20 grams of dye solution (1% active), 0.86 grams of $CaCl_2$ stock (96.5% active), and 10.69 grams of amine oxide stock, and all mixed at a temperature of about 75°-80° F. (about 24°-27° C.) using a Lightnin LABMASTER M5V 1500, MSV 1500 U mixer. The mixture is then heated to 160° F. (71° C.), and 20.20 grams of urea stock (99% active), 1.01 grams of boric acid stock (99% active), 16.0 grams of $Mg(C_{11.8}LAS)_2$ stock, and 0.50 grams of perfume are sequentially added. At 180° F. (82° C.), 29.70 grams of Na $C_{12-15}$ $AE_3S$ stock are added. Mixing is continued around 170°-180° F. (77°-82° C.) until the solution is homogeneous. The final product gels upon cooling and is completely transparent in appearance. Gel viscosity is 1.9 million centipoise. The dishcare gel composition is predominantly in hexagonal liquid crystal form, as determined by X-ray diffraction. The level of electrolytes in the composition is about 3%. The pH at 6% product concentration is 8.3. The IFT of the product is 0.76 dynes/cm (same conditions as Example 1).

EXAMPLE 4

A dishcare gel according to the present invention is made as follows:

| Final Product Formula: | Active Percent |
|---|---|
| Sodium monoethoxylated alkyl sulfate* | 28.5% |
| Amine oxide** | 4.75% |
| Boric acid | 2.0% |
| $Mg^{++}$ from magnesium acetate tetrahydrate | 0.4% |
| Urea | 20.0% |
| Dye | 0.002% |
| Perfume | 0.5% |
| Water | 43.85% |

*Na $C_{12-13}$ $AE_1S$ (80% active, manufactured by The Procter & Gamble Company, Cincinnati, Ohio, U.S.A.)
**Same as in Example 1

Process

To 23.06 grams of water are added, in sequence, 3.55 grams of magnesium acetate tetrahydrate stock (99% active), 14.84 grams of amine oxide stock, 2.02 grams of boric acid stock (99% active), and 0.2 grams of blue dye solution (1% active), and all mixed at a temperature of about 75°-80° F. (about 24°-27° C.) using a Lightnin LABMASTER MSV 1500, MSV 1500 U mixer. The temperature of the homogenous mixture is then raised to 140° F. (60° C.), and 20.20 grams of urea (99% active) and 0.5 grams of perfume are added. The mixture is further heated to 180° F. (82° C.), and 35.63 grams of Na $C_{12-13}$ $AE_1S$ stock are mixed in. The mixture is then stirred at 180° F. (82° C.) until it is completely homogenous. Cooling of the mixture immediately results in gel formation. The gel has a viscosity of 2,300,000 centipoise. The dishcare gel is predominantly in hexagonal liquid crystal form, as determined by X-ray diffraction. The level of electrolytes in the composition is about 4%.

EXAMPLE 5

A dishcare gel according to the present invention is made as follows:

| Final Product Formula: | Active Percent |
|---|---|
| Sodium monoethoxylated alkyl sulfate* | 28.5% |
| Amine oxide** | 4.75% |
| $Mg^{++}$ from magnesium formate*** | 0.6% |
| Urea | 20.0% |
| Dye | 0.002% |
| Perfume | 0.5% |

-continued

| Final Product Formula: | Active Percent |
|---|---|
| Water | 46.15% |

*Same as in Example 4
**Same as in Example 1
***The magnesium formate (95% active) was purchased from Pfaltz and Bauer Inc., Waterbury Connecticut, U.S.A. It was further purified by dissolving the purchased material in hot water and filtering out the insoluble particles. The water was removed from the soluble fraction by evaporation to dryness. The resulting white powder was then stored in an oven prior to use.

Process

To 25.66 grams of water are added, in sequence, 14.84 grams of amine oxide stock and 0.20 grams of blue dye solution (1% active), both added at a temperature of about 75°-80° F. (about 24°-27° C.). The solution is then stirred and heated, and at 150° F. (66° C.) are added 0.50 grams of perfume, 2.97 grams of magnesium formate stock (95% active) and 20.20 grams of urea stock (99% active). The mixture is further heated to 180° F. (82° C.) and 35.63 grams of Na $C_{12-13}$ $AE_1S$ stock are added. Stirring is continued at 180° F. (82° C.) until the solution is nearly homogeneous. Cooling results in gel formation. Gel viscosity is 2,500,000 centipoise. The dishcare gel composition is predominantly in hexagonal liquid crystal form. The level of electrolytes in the composition is about 4%.

EXAMPLE 6

A dishcare gel according to the present invention is made as follows:

| Final Product Formula: | Active Percent |
|---|---|
| Sodium monoethoxylated alkyl sulfate* | 28.5% |
| Amine oxide** | 4.75% |
| Boric acid | 2.0% |
| $Mg^{++}$ from magnesium sulfate | 0.4% |
| Urea | 20.0% |
| Dye | 0.002% |
| Perfume | 0.5% |
| Water | 44.35% |

*Same as in Example 4
**Same as in Example 1

Process

To 24.59 grams of water preheated to 140° C. (60° C.), are added, in sequence, 2.02 grams of magnesium sulfate (99% active), 14.84 grams of amine oxide stock, 0.20 grams of blue dye solution (1% active), 0.50 grams of perfume, 20.20 grams of urea stock (99% active) and 2.02 grams of boric acid stock (99% active). The mixture was then allowed to stir and heated to 180° F. (82° C.). At 180° F. (82° C.), 35.65 grams of Na $C_{12-13}$ $AE_1S$ stock was added to the homogeneous mixture. The solution was further stirred and heated until all of the $AE_1S$ was completely dissolved. The finished product is liquid and homogeneous at 180° F. (82° C.), and forms a beautiful clear, transparent gel upon cooling. Gel viscosity is 1,600,000 centipoise. The dishcare gel composition is predominantly in hexagonal liquid crystal form, as determined by X-ray diffraction. The level of electrolytes is about 4%.

EXAMPLE 7

The following dishwashing gel samples illustrate the influence of urea on gel viscosity. The ingredient amounts are in weight percent of active. (The percentage of water and minor ingredients are not disclosed.)

| | (a) | (b) | (c) | (d) | (e) | (f) |
|---|---|---|---|---|---|---|
| Urea | 10 | 15 | 20 | 12 | 15 | 20 |
| $NaAE_1S$ | 22.5 | 22.5 | 22.5 | 20.6 | 20.6 | 20.6 |
| $Mg(LAS)_2$ | 7.5 | 7.5 | 7.5 | 8 | 8 | 8 |
| Amine Oxide | 2.6 | 2.6 | 2.6 | 3.4 | 3.4 | 3.4 |
| Boric Acid | 1.0 | 1.5 | 2.0 | 1.2 | 1.5 | 2.0 |
| $Mg^{++}$ from $MgSO_4$ | 0.36 | 0.36 | 0.36 | — | — | — |
| $Mg^{++}$ from Magnesium Citrate | — | — | — | 0.3 | 0.3 | 0.3 |
| pH | 8.77 | 8.72 | 8.59 | 8.99 | 8.89 | 8.7 |
| Viscosity (Million cP) | 2.3 | 3.6 | 3.0 | 2.6 | 4.9 | 4.9 |

EXAMPLE 8

Following are some additional dishwashing gel samples made according to the present invention. The ingredient amounts are in weight percent of active. (The percentages of water and minor ingredients are not disclosed.) The samples contain a Methocel thickener or a sodium silicate thickener/abrasive.

| | (a) | (b) | (c) | (d) |
|---|---|---|---|---|
| $NaAE_xS$ | 25 | 22.5 | 30 | 30 |
| where x= | 1 | 3 | 1 | 1 |
| $Mg(LAS)_2$ | 9 | 7.5 | 0 | 0 |
| Urea | 20 | 25 | 25 | 20 |
| Betaine | 0 | 0.9 | 0 | 0 |
| Amine Oxide | 2.6 | 2.6 | 2.6 | 2.6 |
| $Mg^{++}$ from $MgSO_4$ | 0.38 | 0.36 | 0.87 | 0.87 |
| Boric Acid | 2 | 2 | 2.5 | 2 |
| Methocel | 2 | 0 | 0 | 0 |
| Sodium Silicate | 0 | 5 | 5 | 5 |
| pH | 8.41 | 8.15 | 8.54 | 8.57 |
| Viscosity (Million cP) | 7.6 | 4.9 | 4.7 | 5.1 |

What is claimed is:

1. A detergent composition comprising a gel wholly or predominantly in hexagonal liquid crystal form, said gel comprising:

(a) from about 15% to about 70% by weight of a surfactant system, wherein at least about 40% by weight of the surfactant system is an ethoxylated alkyl sulfate surfactant, wherein the alkyl group of the ethoxylated alkyl sulfate surfactant has an average of from about 8 to about 20 carbon atoms, and wherein the ethoxylated alkyl sulfate surfactant has an average degree of ethoxylation of from 0.5 to about 15%;

(b) from 1% to about 45% by weight of an additive which is a water-soluble non-micelle-forming or weakly micelle-forming material capable of forcing the surfactant system into hexagonal phrase, the additive being anionic or nonionic and having at most 6 aliphatic carbon atoms, and the additive being selected from the group consisting of the lower amides and mixtures thereof; and (c) from about 20% to about 70% by weight of water;

(d) wherein the surfactant system contains not more than about 25% secondary surfactant by weight of the surfactant system, wherein the secondary surfactant is an anionic surfactant having a polar head group and one or more linear or branched aliphatic or araliphatic hydrocarbon chains containing in total at least 8 aliphatic carbon atoms, the polar head group being positioned non-terminally ill in a single hydrocarbon chain or carrying more than one hydrocarbon chain, or two or more such surfactants of the same charge type.

2. A detergent composition according to claim 1 which comprises from about 20% to about 55% by weight surfactant system.

3. A detergent composition according to claim 1 wherein at least about 55% by weight of the surfactant system is the ethoxylated alkyl sulfate surfactant.

4. A detergent composition according to claim 1 which contains from about 15% to about 65% ethoxylated alkyl sulfate surfactant by weight of the detergent composition.

5. A detergent composition according to claim 1 wherein the alkyl group of the ethoxylated alkyl sulfate surfactant has an average of from about 8 to about 15 carbon atoms.

6. A detergent composition according to claim 1 wherein the ethoxylated alkyl sulfate surfactant has an average degree of ethoxylation of from about 1 to about 6.5.

7. A detergent composition according to claim 1 wherein the cation group combined with the ethoxylated alkyl sulfate surfactant is selected from the group consisting of sodium, magnesium, and mixtures thereof.

8. A detergent composition according to claim 1 wherein the ethoxylated alkyl sulfate surfactant is a sodium ethoxylated alkyl sulfate, and which additionally contains from about 0.3% to about 1.5% $Mg^{++}$ ions by weight of the composition.

9. A detergent composition according to claim 1 which comprises from about 5% to about 40% additive.

10. A detergent composition according to claim 1 wherein the additive is urea.

11. A detergent composition according to claim 10 which contains from about 10% to about 25% urea.

12. A detergent composition according to claim 1 which comprises from about 25% to about 55% water.

13. A detergent composition according to claim 1 wherein the surfactant system additionally contains from 1% to about 25% of a secondary surfactant, by weight of the surfactant system, wherein the secondary surfactant is an anionic surfactant having a polar head group and one or more linear or branched aliphatic or araliphatic hydrocarbon chains containing in total at least 8 aliphatic carbon atoms, the polar head group being positioned non-terminally in a single hydrocarbon chain or carrying more than one hydrocarbon chain; or two or more such surfactants of the same charge type.

14. A detergent composition according to claim 13 wherein the surfactant system contains from about 10% to about 25% of the secondary surfactant, by weight of the surfactant system.

15. A detergent composition according to claim 13 wherein the weight ratio of ethoxylated alkyl sulfate surfactant to secondary surfactant in the surfactant system is at least about 2:1.

16. A detergent composition according to claim 1 wherein the surfactant system additionally contains from 1% to about 45% nonionic surfactant by weight of the surfactant system.

17. A detergent composition according to claim 16 wherein the weight ratio of ethoxylated alkyl sulfate surfactant to nonionic surfactant is at least about 1.5:1.

18. A detergent composition according to claim 1 which contains not more than about 45%, by weight of the surfactant system, surfactants selected from the group consisting of cationic surfactants, zwitterionic surfactants, ampholitic surfactants, amphoteric surfactants, anionic surfactants that are not ethoxylated alkyl sulfate surfactants or secondary surfactants, and mixtures thereof.

19. A detergent composition according to claim 10 which additionally contains from about 0.1% to about 5.0% boric acid by weight of the detergent.

20. A detergent composition according to claim 19 wherein the ratio of ethoxylated alkyl sulfate surfactant to boric acid is from about 50:1 to about 5:1.

21. A detergent composition according to claim 1 wherein the level of electrolytes is less than about 10% by weight of the detergent.

22. A detergent composition according to claim 1, wherein the detergent composition has a viscosity between about 1,000,000 centipoise and about 8,000,000 centipoise.

23. A detergent composition according to claim 1 wherein the composition is a dishcare gel, and wherein the gel has a viscosity between about 1,000,000 centipoise and about 6,000,000 centipoise.

* * * * *